US006042110A

United States Patent [19]

Inage

[11] Patent Number: 6,042,110

[45] Date of Patent: Mar. 28, 2000

[54] BILL ALIGNMENT DEVICE FOR BILL HANDLING MACHINE

[75] Inventor: Toru Inage, Kasukabe, Japan

[73] Assignee: Laurel Bank Machines Co., Ltd., Tokyo, Japan

[21] Appl. No.: 08/984,574

[22] Filed: Dec. 3, 1997

[30] Foreign Application Priority Data

Dec. 9, 1996 [JP] Japan ..... 8-328960
Nov. 27, 1997 [JP] Japan ..... 9-325700

[51] Int. Cl.[7] ..... B65H 9/16
[52] U.S. Cl. ..... 271/251
[58] Field of Search ..... 271/251, 250

[56] References Cited

U.S. PATENT DOCUMENTS

| | | | |
|---|---|---|---|
| 3,908,986 | 9/1975 | Bleau . | |
| 5,381,021 | 1/1995 | Polidoro | 271/251 X |
| 5,564,544 | 10/1996 | Takemoto et al. . | |
| 5,657,983 | 8/1997 | Fisk | 271/251 |
| 5,695,186 | 12/1997 | Phillips et al. | 271/251 X |
| 5,897,258 | 4/1999 | Wen et al. | 271/251 X |

FOREIGN PATENT DOCUMENTS

| | | |
|---|---|---|
| 0 317 537 A2 | 5/1989 | European Pat. Off. . |
| 0 581 392 A2 | 2/1994 | European Pat. Off. . |
| 60-211588 | 10/1985 | Japan . |

*Primary Examiner*—David H. Bollinger

*Attorney, Agent, or Firm*—Frishauf, Holtz, Goodman, Langer & Chick, P.C.

[57] ABSTRACT

A bill alignment device for a bill handling machine includes a reference surface provided at one side portion of a bill transport passage in parallel thereto and along which bills are to be aligned, support shafts disposed to form a predetermined angle with the reference surface so that a cross point between an axis thereof and the one side portion of the bill transport passage is positioned upstream of a cross point between the axis thereof and the other side portion of the bill transport passage, a pair of transport rollers eccentrically mounted on each of the support shafts and spaced from each other, and a guide plate having concave portions facing the pairs of transport rollers and adapted to guide the bills on an upper surface thereof, the pair of transport rollers being mounted on each of the support shafts so that rotation positions where degree of eccentricity is maximum are offset from each other by 180 degrees, that a part of each of the pair of transport rollers is positioned in one of the concave portions when the rotation position where degree of eccentricity is maximum is directed downward and that the smallest clearance between a circumference of each of the pair of transport rollers and the upper surface of the guide plate exceeds the thickness of one bill when the rotation position where the degree of eccentricity is maximum is directed upward. According to the thus constituted bill alignment device, it is possible to align even bills having extremely low rigidity and apt to be bent along a reference surface, while the bills are being transported.

16 Claims, 3 Drawing Sheets

BILL ALIGNMENT DEVICE FOR BILL HANDLING MACHINE

BACKGROUND OF THE INVENTION

The present invention relates to a bill alignment device for a bill handling machine and particularly to such a device which can align even bills having extremely low rigidity and apt to be bent along a reference surface, while the bills are being transported.

DESCRIPTION OF THE PRIOR ART

Japanese Patent Application Laid Open No. 60-211588 discloses a form alignment device comprising a feed roller for transporting forms in a predetermined transport direction and a pressure roller whose axis forms an angle θ with the axis of the feed roller for holding the forms between the feed roller and itself and feeding the forms toward a reference wall along which the forms are to be aligned and is adapted to feed the forms toward the reference wall by holding the forms between the feed roller and the pressure roller whose axis forms an angle θ with the axis of the feed roller and feeding the forms, thereby aligning the forms along the reference wall, while the forms are being transported.

However, in the thus constituted form alignment device, since the form is aligned along the reference wall while it is being held between the pressure roller and the feed roller, in the case of applying the device for aligning a bill such as one circulated for a long time having extremely low rigidity and apt to be bent along the reference wall while it is being transported, the bill is bent by the force applied from the pressure roller thereto after the bill was aligned along the reference wall and, therefore, it is difficult to align such bills along the reference wall.

SUMMARY OF THE INVENTION

It is therefore an object of the present invention to provide a bill alignment device for a bill handling machine which can align even bills having extremely low rigidity and apt to be bent along a reference surface, while the bills are being transported.

The above and other objects of the present invention can be accomplished by a bill alignment device for a bill handling machine comprising a reference surface provided at one side portion of a bill transport passage in parallel thereto and along which bills are to be aligned, at least one support shaft disposed to form a predetermined angle with the reference surface so that a cross point between an axis thereof and the one side portion of the bill transport passage is positioned upstream of a cross point between the axis thereof and the other side portion of the bill transport passage, a pair of transport rollers eccentrically mounted on the at least one support shaft and spaced from each other, and a guide plate having concave portions facing the pair of transport rollers and adapted to guide the bills on an upper surface thereof, the pair of transport rollers being mounted on the at least one support shaft so that rotation positions where degree of eccentricity is maximum are offset from each other by 180 degrees, that a part of each of the pair of transport rollers is positioned in one of the concave portions when the rotation position where degree of eccentricity is maximum is directed downward and that the smallest clearance between a circumference of each of the pair of transport rollers and the upper surface of the guide plate exceeds the thickness of one bill when the rotation position where the degree of eccentricity is maximum is directed upward.

In a preferred aspect of the present invention, the smallest clearance between a circumference of each of the pair of transport rollers and the upper surface of the guide plate is determined to be greater than double the thickness of one bill when the rotation position where the degree of eccentricity is maximum is directed upward.

In a further preferred aspect of the present invention, the bill alignment device comprises two or more support shafts and the pair of transport rollers are eccentrically mounted on each of the support shafts so as to be spaced from each other.

In a further preferred aspect of the present invention, the pairs of transport rollers are mounted on the support shaft so that the transport rollers mounted on the adjacent support shafts and aligned with each other in the bill transport direction are fixed to the support shafts so that the rotation positions where the degree of eccentricity is maximum is are offset from each other by 90 degrees.

In a further preferred aspect of the present invention, a second guide plate is further provided above and in parallel to the guide plate and the pair of transport rollers face the guide plate via openings formed in the second guide plate.

The above and other objects and features of the present invention will become apparent from the following description made with reference to the accompanying drawings.

DESCRIPTION OF THE PREFERRED EMBODIMENTS

Figure 1:
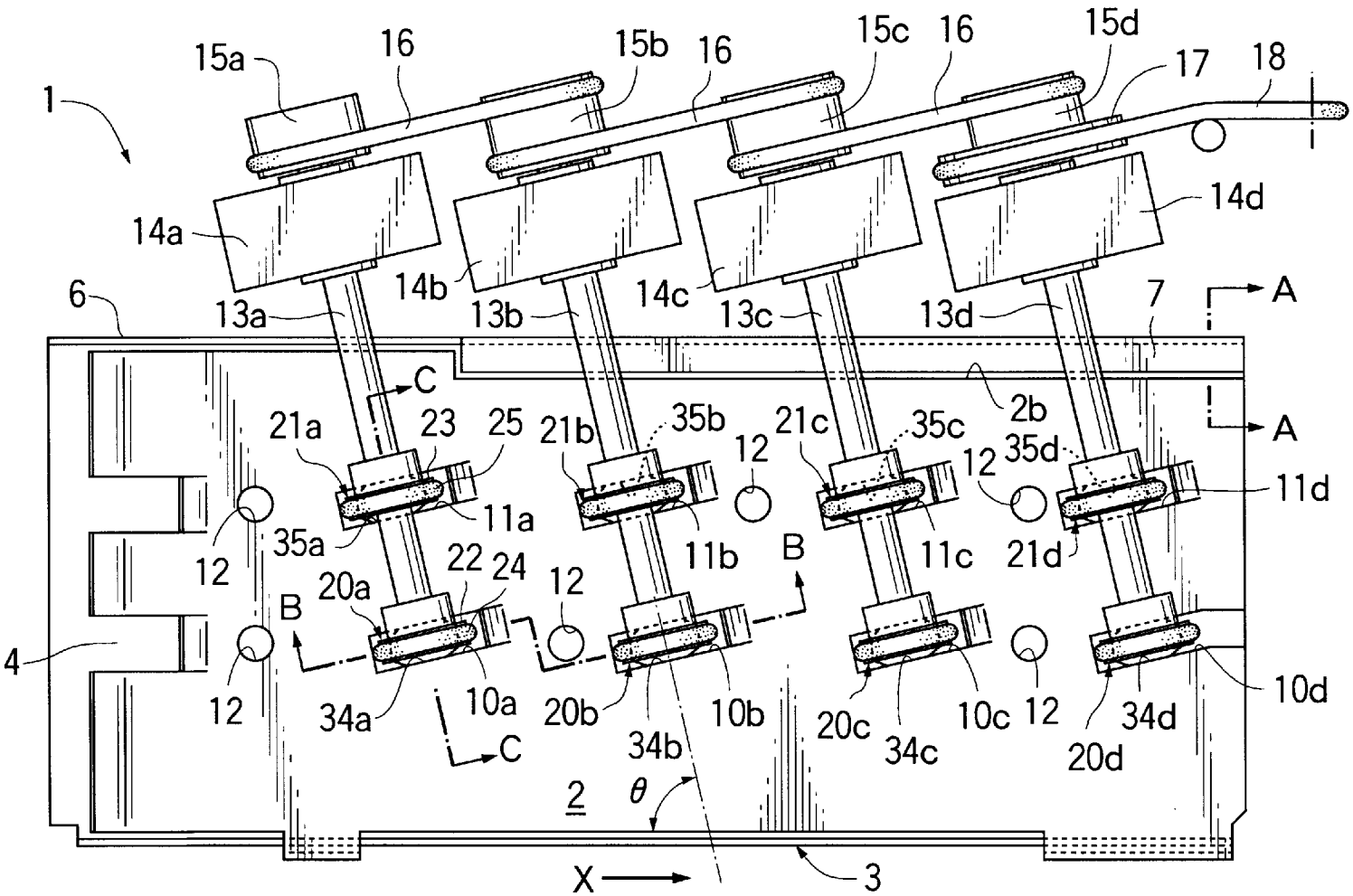
FIG. 1 is a schematic plan view of a bill alignment device which is an embodiment of the present invention.
Figure 2:
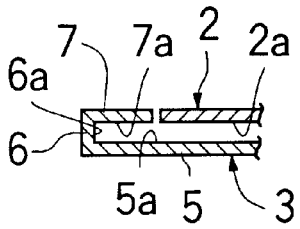
FIG. 2 is a schematic cross-sectional view taken along the line A—A in FIG. 1.

As shown in FIGS. 1 and 2, a bill alignment device 1 includes an upper guide plate 2 and a lower guide plate 3 disposed so as to face each other and a bill transport passage is formed between the upper guide plate 2 and the lower guide plate 3. The lower guide plate 3 comprises a rectangular lower plate 5 whose longer edge is parallel to a bill transport direction indicated by an arrow X in FIG. 1, a side plate 6 extending from one of the side edges of the lower plate 5 parallel to the bill transport direction, and an upper plate 7 extending in parallel to the lower plate 5 from the upper end portion of the side plate 6 toward the other side edge of the lower plate 5 parallel to the bill transport direction so that the lower surface 7*a* thereof lies flush with the lower surface 2*a* of the upper guide plate 2. In this embodiment, since bills are transported in such a manner that their longer edges coincide with the bill transport direction, the width of the lower plate 5 in the direction perpendicular to the bill transport direction is made slightly greater than the width of bills having the greatest width among bills to be handled. The upper surface 5*a* of the lower plate 5 of the lower guide plate 2 serves as a support surface for supporting bills and the inner surface 6*a* of the side plate 6 forms a reference surface along which bills are to be aligned. Further, the lower surface 7*a* of the upper plate 7 and the lower surface 2*a* of the upper guide plate 2 prevent bills from being bent.

As shown in FIGS. 1 to 4, the upper guide plate 2 is disposed in parallel to the lower guide plate 3 and has a substantially rectangular shape whose longer edges are parallel to the bill transport direction. The upper guide plate 2 is formed with a cut portion 2*b* at one of side edge portions thereof parallel to the bill transport direction, which corresponds to the upper plate 7 of the lower guide plate 3. The width of the upper guide plate 2 in the direction perpendicular to the bill transport direction is determined to be slightly greater than that of bills having the maximum width to be handled.

Figure 3:
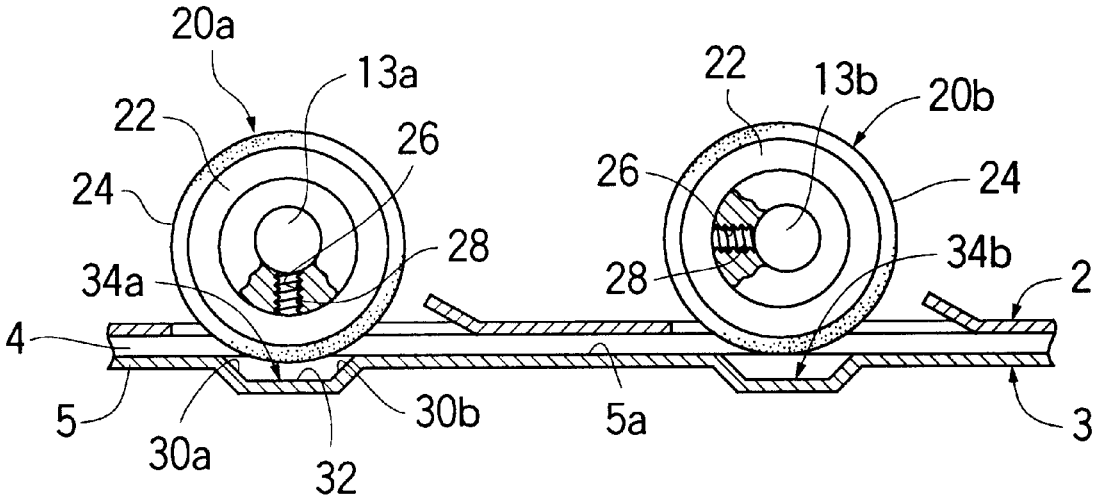
FIG. 3 is a schematic partially broken and cross-sectional view taken along the line B—B in FIG. 1.
Figure 4:
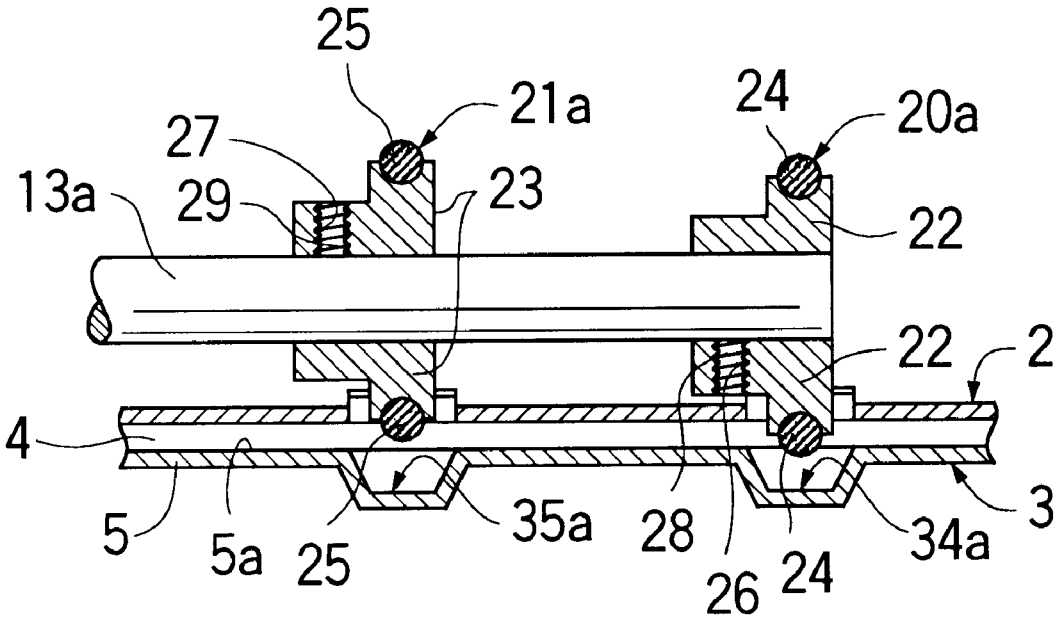
FIG. 4 is a schematic cross-sectional view taken along the line C—C in FIG. 1.

As shown in FIGS. 1, 3 and 4, the upper guide plate 3 is formed with rectangular shaped openings 10*a*, 11*a*, 10*b*, 11*b*, 10*c*, 11*c*, 10*d*, 11*d*. The openings 10*a*, 11*a*, the openings 10*b*, 11*b*, the openings 10*c*, 11*c* and the openings 10*d*, 11*d* respectively form pairs and are formed so that the longer edges thereof are parallel to each other and each of straight lines connecting the centers thereof forms an angle of θ with the bill transport direction. The openings 10*a*, 10*b*, 10*c* and 10*d* are formed so that their positions in the direction perpendicular to the bill transport direction coincide with each other and the spaces between the openings 10*a* and 10*b*, the openings 10*b* and 10*c* and the openings 10*c* and 10*d* are made to be equal to each other. Similarly, The openings 11*a*, 11*b*, 11*c* and 11*d* are formed so that their positions in the direction perpendicular to the bill transport direction coincide with each other and the spaces between the openings 11*a* and 11*b*, the openings 11*b* and 11*c* and the openings 11*c* and 11*d* are made to be equal to each other.

The upper guide plate 2 and the lower plate 5 of the lower guide plate 3 are further formed with a plurality of apertures 12 for allowing light emitted from light emitting elements of optical sensors (not shown) for detecting bills immediately before they reach the openings 10*a*, 11*a*, 10*b*, 11*b*, 10*c*, 11*c*, 10*d*, 11*d* to pass and be received by light receiving elements.

Support shafts 13*a*, 13*b*, 13*c*, 13*d* are provided above each of the openings 10*a*, 11*a*, the openings 10*b*, 11*b*, the openings 10*c*, 11*c* and the openings 10*d*, 11*d* respectively, so that each of them extends in a plane perpendicular to the upper guide plate 2 and containing a straight line each connecting the centers of openings 10*a*, 11*a*, the openings 10*b*, 11*b*, the openings 10*c*, 11*c* or the openings 10*d*, 11*d* and in parallel to the upper guide plate 2. One end portion of each support shaft 13*a*, 13*b*, 13*c* or 13*d* is rotatably supported by a support block 14*a*, 14*b*, 14*c* or 14*d* each fixed to the body of the bill handling machine outside of the side plate 6 of the lower guide plate 3. Each of the support shafts 13*a*, 13*b*, 13*c*, 13*d* forms an angle of θ with the bill transport direction.

Pulleys 15*a*, 15*b*, 15*c*, 15*d* of equal diameters are fixed to the portions of the support shafts 13*a*, 13*b*, 13*c*, 13*d* projecting from the support blocks 14*a*, 14*b*, 14*c*, 14*d* opposite to the upper guide plate 2 and the lower guide plate 3 and round belts 16 are wound around the adjacent pulleys 15*a*, 15*b*, 15*c*, 15*d*. A pulley 17 having a greater diameter is fixed to the pulley 15*d* positioned most downstream and is connected to the rotation shaft of a motor (not shown) via a round belt 18. Thus, when the motor is driven, all of the support shafts 13*a*, 13*b*, 13*c*, 13*d* are rotated in the same direction and at the same speed.

As shown in FIGS. 3 and 4, pairs of transport rollers 20*a* and 21*a*, 20*b* and 21*b*, 20*c* and 21*c*, and 20*d* and 21*d* are fixed to the support shafts 13*a*, 13*b*, 13*c*, 13*d*, respectively. The transport rollers 20*a*, 21*a*, 20*b*, 21*b*, 20*c*, 21*c*, 20*d* and 21*d* are fixed to the associated support shafts 13*a*, 13*b*, 13*c*, 13*d* so as to be eccentric and be spaced from each other. The transport rollers 20*a*, 21*a*, 20*b*, 21*b*, 20*c*, 21*c*, 20*d* and 21*d* are each constituted by winding a round belt 24, 25 around an eccentric pulley 22, 23 so as to have the equal diameters and are fixed to the support shafts 13*a*, 13*b*, 13*c*, 13*d* so that the degrees of eccentricity thereof are the same. The transport rollers 20*a*, 20*b*, 20*c* and 20*d* are disposed so as to face the lower plate 5 of the lower guide plate 3 via the openings 10*a*, 10*b*, 10*c*, 10*d* and a part thereof is positioned in the openings 10*a*, 10*b*, 10*c*, 10*d*. The transport rollers 21*a*, 21*b*, 21*c* and 21*d* are disposed so as to face the lower plate 5 of the lower guide plate 3 via the openings 11*a*, 11*b*, 11*c*, 11*d* and a part thereof is positioned in the openings 11*a*, 11*b*, 11*c*, 11*d*. The eccentric pulleys 22, 23 are respectively fixed to the support shafts 13*a*, 13*b*, 13*c*, 13*d* by threads 28, 29 screwed into tread openings 26, 27 formed from rotation positions where the degrees of eccentricity are maximum toward the support shafts 13*a*, 13*b*, 13*c*, 13*d*.

As shown for the pair of transport rollers 20*a* and 21*a* in FIG. 4, the pairs of transport rollers 20*a* and 21*a*, 20*b* and 21*b*, 20*c* and 21*c*, and 20*d* and 21*d* fixed to the same support shafts 13*a*, 13*b*, 13*c*, 13*d* are fixed to the support shafts 13*a*, 13*b*, 13*c*, 13*d* so that the rotation positions where the degrees of eccentricity is maximum are offset by 180 degrees.

As shown for the transport rollers 20*a*, 20*b* in FIG. 3, the set of transport rollers 20*a*, 20*b*, 20*c* and 20*d*, and the set of transport rollers 21*a*, 21*b*, 21*c* and 21*d* fixed to the adjacent support shafts 13*a*, 13*b*, 13*c*, 13*d* are fixed to the support shafts 13*a*, 13*b*, 13*c*, 13*d* so that the rotation positions of the transport rollers of each set where the degrees of eccentricity are maximum are offset by 90 degrees.

Positions of the lower plate 5 of the lower guide plate 3 corresponding to the openings 10*a*, 11*a*, 10*b*, 11*b*, 10*c*, 11*c*, 10*d*, 11*d* are formed with concave portions 34*a*, 35*a*, 34*b*, 35*b*, 34*c*, 35*c*, 34*d*, 35*d* constituted by inclined surface portions 30*a*, 30*b* forming a predetermined angle with the upper surface 5*a* of the lower plate 5 and flat surface portions 32 parallel to the upper surface 5*a* of the lower plate 5.

The transport rollers 20*a*, 21*a*, 20*b*, 21*b*, 20*c*, 21*c*, 20*d* and 21*d* are fixed to the support shafts 13*a*, 13*b*, 13*c*, 13*d* so that when the rotation position where the degree of eccentricity is maximum is directed downward, a part of each of the transport rollers 20*a*, 21*a*, 20*b*, 21*b*, 20*c*, 21*c*, 20*d* and 21*d* projects downward from the upper surface 5*a* of the lower plate 5 and is located in the concave portion 34*a*, 35*a*, 34*b*, 35*b*, 34*c*, 35*c*, 34*d*, 35*d*. On the other hand, the transport rollers 20*a*, 21*a*, 20*b*, 21*b*, 20*c*, 21*c*, 20*d* and 21*d* are fixed to the support shafts 13*a*, 13*b*, 13*c*, 13*d* so that when the rotation position where the degree of eccentricity is maximum is directed upward, the smallest clearance between the circumference of each of the transport rollers 20*a*, 21*a*, 20*b*, 21*b*, 20*c*, 21*c*, 20*d* and 21*d* and the upper surface 5*a* of the lower plate 5 is greater than double the thickness of bills to be handled. Further, the transport rollers 20*a*, 21*a*, 20*b*, 21*b*, 20*c*, 21*c*, 20*d* and 21*d* are fixed to the support shafts 13*a*, 13*b*, 13*c*, 13*d* so that when the rotation position where the degree of eccentricity is maximum is located at the position where each of the transport rollers 20*a*, 21*a*, 20*b*, 21*b*, 20*c*, 21*c*, 20*d* and 21*d* is rotated by 90 degrees from the position where the rotation position where the degree of eccentricity is maximum is directed downward or the position where the rotation position where the degree of eccentricity is maximum is directed upward, the smallest clearance between the circumference of each of the transport rollers 20*a*, 21*a*, 20*b*, 21*b*, 20*c*, 21*c*, 20*d* and 21*d* and the upper surface 5*a* of the lower plate 5 is about equal to or greater than the thickness of one bill to be handled. The thickness of one bill is generally 0.09 to 0.1 mm. Therefore, in this embodiment, the transport rollers 20*a*, 21*a*, 20*b*, 21*b*, 20*c*, 21*c*, 20*d* and 21*d* are fixed to the support shafts 13*a*, 13*b*, 13*c*, 13*d* so that the degree of eccentricity of each is determined to be 0.3 mm, that each projects from the upper surface 5*a* of the lower plate 5 by 0.1 mm when the rotation position where the degree of eccentricity is maximum is directed downward, that the smallest clearance between the circumference of each and the upper surface 5*a* of the lower plate 5 is determined to be 0.5 mm when the rotation position where the degree of eccentricity is maximum is directed upward, and that the smallest clearance between the circumference of each and the upper surface 5*a* of the lower plate 5 is determined to be 0.2 mm when the rotation position where the degree of eccentricity is maximum is located at the position where each of the transport rollers 20*a*, 21*a*, 20*b*, 21*b*, 20*c*, 21*c*, 20*d* and 21*d* is rotated by 90 degrees from the position where the rotation position where the degree of eccentricity is maximum is directed downward or the position where the rotation position where the degree of eccentricity is maximum is directed upward.

The thus constituted bill alignment device 1 of the bill handling machine aligns bills along the inner surface 6*a* of the side plate 6 of the lower guide plate 3 constituting a reference surface, while transporting bills.

When the motor (not shown) is driven, the driving force of the motor is transmitted to the support shafts 13*a*, 13*b*, 13*c*, 13*d* via the pulley 17 and the pulleys 15*a*, 15*b*, 15*c*, 15*d*, thereby rotating the support shafts 13*a*, 13*b*, 13*c*, 13*d* counterclockwise in FIG. 3.

A bill fed into a portion between the upper guide plate 2 and the lower guide plate 3 is guided on the upper surface 5*a* of the lower plate 5 of the lower guide plate 3 and fed to a portion between the transport rollers 20*a*, 21*a* and the lower plate 5 of the lower guide plate 3. Since the transport rollers 20*a*, 21*a* are fixed to the support shaft 13*a* so that the rotation positions where the degree of eccentricity is maximum of the transport rollers 20*a*, 21*a* are offset by 180 degrees, the bill is pushed into one of the concave portions 34*a*, 35*a* by one of the transport rollers 20*a*, 21*a* as the support shaft is rotated, whereby the bill is transported by a frictional force produced between itself and one of the transport rollers 20*a*, 21*a*. Since the shaft 13*a* extends at an angle of θ with the bill transport direction, the bill is transported in the bill transport direction while being urged toward the inner surface 6*a* of the side plate 6 of the lower guide plate 3 constituting a reference surface. When the support shaft 13*a* has been rotated by 180 degrees, the bill is pushed into the concave portions 34*a*, 35*a* by the other of the transport rollers 20*a*, 21*a*, whereby the bill is transported in the bill transport direction while being urged toward the inner surface 6*a* of the side plate 6 of the lower guide plate 3 constituting the reference surface.

The bill is further fed into a portion between the transport rollers 20*b*, 21*b* and the lower plate 5 of the lower guide plate 3 and is pushed by one of the transport roller 20*b* or 21*b* into the corresponding concave portions 34*b*, 35*b* as the support shaft 13*b* is rotated, whereby the bill is transported in the bill transport direction while being urged toward the inner surface 6*a* of the side plate 6 of the lower guide plate 3 constituting the reference surface. When the support shaft 13*b* has been rotated by 180 degrees, the bill is pushed by the other transport roller 20*b* or 21*b* into the corresponding concave portion 34*b*, 35*b*, whereby the bill is transported in the bill transport direction while being urged toward the inner surface 6*a* of the side plate 6 of the lower guide plate 3 constituting the reference surface.

Similarly, the bill is further transported in the bill transport direction by the transport rollers 20*c*, 21*c* and 20*d*, 21*d* while being urged toward the inner surface 6*a* of the side plate 6 of the lower guide plate 3 constituting the reference surface, whereby the bill is aligned so that the longer edge thereof is aligned along the inner surface 6*a* of the side plate 6 of the lower guide plate 3 constituting the reference surface. In this manner, in this embodiment, the bill is pushed by the transport rollers 20*a*, 21*a*, 20*b*, 21*b*, 20*c*, 21*c*, 20*d*, 21*d* into the corresponding concave portions 34*a*, 35*a*, 34*b*, 35*b*, 34*c*, 35*c*, 34*d*, 35*d* and is merely fed toward the inner surface 6*a* of the side plate 6 of the lower guide plate 3 by a frictional force produced between the bill and the transport rollers 20*a*, 21*a*, 20*b*, 21*b*, 20*c*, 21*c*, 20*d*, 21*d*, while it is being transported in the bill transport direction. Therefore, since no excess force is applied to the bill which has been aligned so that the longer edge is aligned along the inner surface 6*a* of the side plate 6 of the lower guide plate 3, it is possible to prevent aligned bills from being folded or bent and to align bills so that their longer edges are aligned along the inner surface 6*a* of the side plate 6 of the lower guide plate 3. Further, since each of the transport rollers 20*a*, 21*a*, 20*b*, 21*b*, 20*c*, 21*c*, 20*d*, 21*d* is constituted by winding the round belt 24 or 25 around the eccentric pulley 22 or 23, the area of a bill which each of the transport rollers 20*a*, 21*a*, 20*b*, 21*b*, 20*c*, 21*c*, 20*d*, 21*d* contact is small. Therefore, since no excess force is applied to the bill, it is possible to reliably prevent aligned bills from being folded or bent and to align bills so that their longer edges are aligned along the inner surface 6*a* of the side plate 6 of the lower guide plate 3.

In this embodiment, the members of each pair of transport rollers 20*a* and 21*a*, 20*b* and 21*b*, 20*c* and 21*c*, 20*d* and 21*d* fixed to the common support shaft 13*a*, 13*b*, 13*c* or 13*d* are fixed to the support shaft 13*a*, 13*b*, 13*c* or 13*d* so that the rotation positions where the degree of eccentricity is maximum are offset from each other and when the bill is pushed into the concave portions 34*a*, 34*b*, 34*c* and/or 34*d* by the transport rollers 20*a*, 20*b*, 20*c* and/or 20*d*, the smallest clearances between the circumferences of the transport rollers 20*a*, 20*b*, 20*c* and/or 20*d* and the upper surface 5*a* of the lower plate 5 are determined to be greater than double the thickness of the bill. Further, the transport rollers 20*a*, 20*b*, 20*c*, 20*d*, 21*a*, 21*b*, 21*c*, 21*d* fixed to the support shafts 13*a*, 13*b*, 13*c*, 13*d* and aligned in the bill transport direction fixed to the support shafts 13*a*, 13*b*, 13*c*, 13*d* so that the rotation positions where the degree of eccentricity is maximum are offset from each other by 90 degrees and when the rotation position where the degree of eccentricity is maximum is located at the position where each of the transport rollers 20*a*, 21*a*, 20*b*, 21*b*, 20*c*, 21*c*, 20*d* and 21*d* is rotated by 90 degrees from the position where the rotation position where the degree of eccentricity is maximum is directed downward or the position where the rotation position where the degree of eccentricity is maximum is directed upward, the smallest clearance between the circumference of each of the transport rollers 20*a*, 21*a*, 20*b*, 21*b*, 20*c*, 21*c*, 20*d* and 21*d* and the upper surface 5*a* of the lower plate 5 is greater than about the thickness of one bill to be handled. Therefore, when the bill is pushed into the concave portion 34*a* by the transport roller 20*a*, no force is applied to the bill from the transport roller 21*a* and the transport roller 21*a* fixed to the adjacent support shaft 13*b*. Accordingly, after a part of the bill abutted against the inner surface 6*a* of the side plate 6 of the lower guide plate 3 constituting the reference surface, the bill can turn so that the longer edge thereof is aligned along the inner surface 6*a* of the side plate 6, thereby enabling the bill to be aligned so that the longer edge thereof is aligned along the inner surface 6*a* of the side plate 6 of the lower guide plate 3 constituting the reference surface.

According to the above described embodiment, the bill is pushed by the transport rollers 20*a*, 21*a*, 20*b*, 21*b*, 20*c*, 21*c*, 20*d*, 21*d* into the corresponding concave portions 34*a*, 35*a*, 34*b*, 35*b*, 34*c*, 35*c*, 34*d*, 35*d* and is merely fed toward the inner surface 6*a* of the side plate 6 of the lower guide plate 3 by a frictional force produced between the bill and the transport rollers 20*a*, 21*a*, 20*b*, 21*b*, 20*c*, 21*c*, 20*d*, 21*d*, while it is being transported in the bill transport direction. Therefore, since no excess force is applied to the bill which has been aligned so that the longer edge is aligned along the inner surface 6*a* of the side plate 6 of the lower guide plate 3, it is possible to prevent aligned bills from being folded or bent and to align bills so that their longer edges are aligned along the inner surface 6*a* of the side plate 6 of the lower guide plate 3. Further, in the above described embodiment, the members of each pair of transport rollers 20*a* and 21*a*, 20*b* and 21*b*, 20*c* and 21*c*, 20*d* and 21*d* fixed to the common support shaft 13*a*, 13*b*, 13*c* or 13*d* are fixed to the support shaft 13*a*, 13*b*, 13*c* or 13*d* so that the rotation positions where the degree of eccentricity is maximum are offset from each other and when the bill is pushed into the concave portions 34*a*, 34*b*, 34*c* and/or 34*d* by the transport rollers 20*a*, 20*b*, 20*c* and/or 20*d*, the smallest clearances between the circumferences of the transport rollers 20*a*, 20*b*, 20*c* and/or 20*d* and the upper surface 5*a* of the lower plate 5 are determined to be greater than double the thickness of the bill. Further, the transport rollers 20*a*, 20*b*, 20*c*, 20*d*, 21*a*, 21*b*, 21*c*, 21*d* fixed to the support shafts 13*a*, 13*b*, 13*c*, 13*d* and aligned in the bill transport direction are fixed to the support shafts 13*a*, 13*b*, 13*c*, 13*d* so that the rotation positions where the degree of eccentricity is maximum are offset from each other by 90 degrees and when the rotation position where the degree of eccentricity is maximum is located at the position where each of the transport rollers 20*a*, 21*a*, 20*b*, 21*b*, 20*c*, 21*c*, 20*d* and 21*d* is rotated by 90 degrees from the position where the rotation position where the degree of eccentricity is maximum is directed downward or the position where the rotation position where the degree of eccentricity is maximum is directed upward, the smallest clearance between its circumference of each of the transport rollers 20*a*, 21*a*, 20*b*, 21*b*, 20*c*, 21*c*, 20*d* and 21*d* and the upper surface 5*a* of the lower plate 5 is greater than about the thickness of one bill to be handled. Therefore, when the bill is pushed into the concave portion 34*a* by the transport roller 20*a*, no force is applied to the bill from the transport roller 21*a* and the transport roller 21*a* fixed to the adjacent support shaft 13*b*. Accordingly, after a part of the bill abutted against the inner surface 6*a* of the side plate 6 of the lower guide plate 3 constituting the reference surface, the bill can turn so that the longer edge thereof is aligned along the inner surface 6*a* of the side plate 6, thereby enabling the bill to be aligned so that the longer edge thereof is aligned along the inner surface 6*a* of the side plate 6 of the lower guide plate 3 constituting the reference surface. Moreover, in the above described embodiment, since each of the transport rollers 20*a*, 21*a*, 20*b*, 21*b*, 20*c*, 21*c*, 20*d*, 21*d* is constituted by winding the round belt 24 or 25 around the eccentric pulley 22 or 23, the area of a bill which each of the transport rollers 20*a*, 21*a*, 20*b*, 21*b*, 20*c*, 21*c*, 20*d*, 21*d* contact is small. Therefore, since no excess force is applied to the bill, it is possible to reliably prevent aligned bills from being folded or bent and to align bills so that their longer edges are aligned along the inner surface 6*a* of the side plate 6 of the lower guide plate 3.

The present invention has thus been shown and described with reference to specific embodiments. However, it should be noted that the present invention is in no way limited to the details of the described arrangements but changes and modifications may be made without departing from the scope of the appended claims.

For example, in the above described embodiment, although four support shafts 13*a*, 13*b*, 13*c*, 13*d* each provided with a pair of transport rollers 20*a* and 21*a*, 20*b* and 21*b*, 20*c* and 21*c*, 20*d* and 21*d* are provided, the number of the support shafts may be arbitrarily selected considering how parts of the transport rollers 20*a*, 21*a*, 20*b*, 21*b*, 20*c*, 21*c*, 20*d*, 21*d* project from the upper surface 5*a* of the lower plate 5 when the rotation position where the degree of eccentricity is maximum is directed downward and the like.

Further, in the above described embodiment, although the round belts 16, 18 are used for transmitting the drive force of the motor, it is possible to transmit the drive force of the motor by threading the pulleys 15*a*, 15*b*, 15*c*, 15*d* and the pulley 17 and winding timing belts therearound.

Furthermore, in the above described embodiment, although the transport rollers 20*a*, 20*b*, 20*c*, 20*d*, 21*a*, 21*b*, 21*c*, 21*d* fixed to the adjacent support shafts 13*a*, 13*b*, 13*c*, 13*d* and aligned in the bill transport direction are fixed to the support shafts 13*a*, 13*b*, 13*c*, 13*d* so that the rotation positions where the degree of eccentricity is maximum are offset from each other by 90 degrees, they may be fixed so that the rotation positions where the degree of eccentricity is maximum are offset from each other by 180 degrees or are not offset.

Moreover, in the above described embodiment, the transport rollers 20*a*, 21*a*, 20*b*, 21*b*, 20*c*, 21*c*, 20*d* and 21*d* are fixed to the support shafts 13*a*, 13*b*, 13*c*, 13*d* so that when the rotation position where the degree of eccentricity is maximum is directed upward, the smallest clearance between the circumference of each of the transport rollers 20*a*, 21*a*, 20*b*, 21*b*, 20*c*, 21*c*, 20*d* and 21*d* and the upper surface 5*a* of the lower plate 5 is greater than double the thickness of bills to be handled. However, it is sufficient for the smallest clearance between the circumference thereof and the upper surface 5*a* of the lower plate 5 to be greater than the thickness of bills to be handled and it is not absolutely necessary to determine the clearance to be greater than double the thickness of the bills.

According to the present invention, it is possible to provide a bill alignment device for a bill handling machine which can align even bills having extremely low rigidity and apt to be bent along a reference surface, while the bills are being transported.

I claim:

1. A bill alignment device for a bill handling machine comprising a reference surface provided at one side portion of a bill transport passage in parallel thereto and along which bills are to be aligned, at least one support shaft disposed to form a predetermined angle with the reference surface so that a cross point between an axis thereof and the one side portion of the bill transport passage is positioned upstream of a cross point between the axis thereof and the other side portion of the bill transport passage, a pair of transport rollers eccentrically mounted on the at least one support shaft and spaced from each other, and a guide plate having concave portions facing the pair of transport rollers and adapted to guide the bills on an upper surface thereof, the pair of transport rollers being mounted on the at least one support shaft so that rotation positions where degree of eccentricity is maximum are offset from each other by 180 degrees, that a part of each of the pair of transport rollers is positioned in one of the concave portions when the rotation position where degree of eccentricity is maximum is directed downward and that the smallest clearance between a circumference of each of the pair of transport rollers and the upper surface of the guide plate exceeds the thickness of one bill when the rotation position where the degree of eccentricity is maximum is directed upward.

2. A bill alignment device for a bill handling machine in accordance with claim 1 wherein the smallest clearance between a circumference of each of the pair of transport rollers and the upper surface of the guide plate is determined to be greater than double the thickness of one bill when the rotation position where the degree of eccentricity is maximum is directed upward.

3. A bill alignment device for a bill handling machine in accordance with claim 2 which further comprises two or more support shafts and the pair of transport rollers are eccentrically mounted on each of the support shafts so as to be spaced from each other.

4. A bill alignment device for a bill handling machine in accordance with claim 3 wherein the pairs of transport rollers are mounted on the support shaft so that the transport rollers mounted on the adjacent support shafts and aligned with each other in the bill transport direction are fixed to the support shafts so that the rotation positions where the degree of eccentricity is maximum is are offset from each other by 90 degrees.

5. A bill alignment device for a bill handling machine in accordance with claim 4 which further comprises a second guide plate above and in parallel to the guide plate and wherein the pair of transport rollers face the guide plate via openings formed in the second guide plate.

6. A bill alignment device for a bill handling machine in accordance with claim 3 which further comprises a second guide plate above and in parallel to the guide plate and wherein the pair of transport rollers face the guide plate via openings formed in the second guide plate.

7. A bill alignment device for a bill handling machine in accordance with claim 2 wherein the pairs of transport rollers are mounted on the support shaft so that the transport rollers mounted on the adjacent support shafts and aligned with each other in the bill transport direction are fixed to the support shafts so that the rotation positions where the degree of eccentricity is maximum is are offset from each other by 90 degrees.

8. A bill alignment device for a bill handling machine in accordance with claim 7 which further comprises a second guide plate above and in parallel to the guide plate and wherein the pair of transport rollers face the guide plate via openings formed in the second guide plate.

9. A bill alignment device for a bill handling machine in accordance with claim 2 which further comprises a second guide plate above and in parallel to the guide plate and wherein the pair of transport rollers face the guide plate via openings formed in the second guide plate.

10. A bill alignment device for a bill handling machine in accordance with claim 1 which further comprises two or more support shafts and the pair of transport rollers are eccentrically mounted on each of the support shafts so as to be spaced from each other.

11. A bill alignment device for a bill handling machine in accordance with claim 10 wherein the pairs of transport rollers are mounted on the support shaft so that the transport rollers mounted on the adjacent support shafts and aligned with each other in the bill transport direction are fixed to the support shafts so that the rotation positions where the degree of eccentricity is maximum is are offset from each other by 90 degrees.

12. A bill alignment device for a bill handling machine in accordance with claim 11 which further comprises a second guide plate above and in parallel to the guide plate and wherein the pair of transport rollers face the guide plate via openings formed in the second guide plate.

13. A bill alignment device for a bill handling machine in accordance with claim 1 wherein the pairs of transport rollers are mounted on the support shaft so that the transport rollers mounted on the adjacent support shafts and aligned with each other in the bill transport direction are fixed to the support shafts so that the rotation positions where the degree of eccentricity is maximum is are offset from each other by 90 degrees.

14. A bill alignment device for a bill handling machine in accordance with claim 13 which further comprises a second guide plate above and in parallel to the guide plate and wherein the pair of transport rollers face the guide plate via openings formed in the second guide plate.

15. A bill alignment device for a bill handling machine in accordance with claim 1 which further comprises a second guide plate above and in parallel to the guide plate and wherein the pair of transport rollers face the guide plate via openings formed in the second guide plate.

16. A bill alignment device for a bill handling machine in accordance with claim 3 which further comprises a second guide plate above and in parallel to the guide plate and wherein the pair of transport rollers face the guide plate via openings formed in the second guide plate.

* * * * *